US006835254B2

(12) United States Patent
Hammar et al.

(10) Patent No.: US 6,835,254 B2
(45) Date of Patent: Dec. 28, 2004

(54) RECRYSTALLIZATION OF METAL ALLOY SHEET WITH CONVECTION AND INFRARED RADIATION HEATING

(75) Inventors: Richard Harry Hammar, Utica, MI (US); John E. Carsley, Clinton Township, MI (US); John Robert Bradley, Clarkston, MI (US)

(73) Assignee: General Motors Corporation, Detroit, MI (US)

( * ) Notice: Subject to any disclaimer, the term of this patent is extended or adjusted under 35 U.S.C. 154(b) by 171 days.

(21) Appl. No.: 10/315,509

(22) Filed: Dec. 9, 2002

(65) Prior Publication Data

US 2004/0108022 A1 Jun. 10, 2004

(51) Int. Cl.[7] ..... C22C 1/047
(52) U.S. Cl. ..... 148/564; 148/691; 148/694
(58) Field of Search ..... 199/564, 691, 199/694

(56) References Cited

U.S. PATENT DOCUMENTS

| | | | | |
|---|---|---|---|---|
| 4,474,044 A | * | 10/1984 | Leistner et al. | 72/19.1 |
| 5,868,023 A | * | 2/1999 | Wehner et al. | 72/60 |
| 6,253,588 B1 | | 7/2001 | Rashid et al. | |
| 6,516,645 B2 | * | 2/2003 | Morales et al. | 72/53 |

* cited by examiner

*Primary Examiner*—George Wyszomierski
(74) *Attorney, Agent, or Firm*—Kathryn A. Marra

(57) ABSTRACT

A method is disclosed for heating a cold worked sheet of superplastically formable metal composition to recrystallize its microstructure to a suitably formable condition and further to heat the sheet to a temperature for an immediate forming operation. The method utilizes a combination of hot air convection heating and infrared radiation to rapidly accomplish the heating. High temperature infrared heating elements provide most of the energy during an initial high heating rate phase and then those elements are shut off and heating is completed with controlled temperature hot air to prevent overheating of the sheet metal.

12 Claims, 1 Drawing Sheet

RECRYSTALLIZATION OF METAL ALLOY SHEET WITH CONVECTION AND INFRARED RADIATION HEATING

TECHNICAL FIELD

This invention pertains to the heating of a heavily cold worked metal alloy sheet to recrystallize its microstructure to a highly formable (e.g., superplastic) condition, and to raise its temperature for an immediate forming operation. More specifically, this invention pertains to a method combining infrared radiation heating with convection heating to rapidly heat the cold worked sheet under controlled conditions for such recrystallization and forming.

BACKGROUND OF THE INVENTION

Body panels for automotive vehicles are currently being manufactured using a superplastic forming process applied to certain magnesium-containing aluminum alloy sheet stock. At the present time, the sheet stock is a specially prepared, fine grain microstructure aluminum alloy 5083. AA5083 has a nominal composition, by weight, of about 4 to 5 percent magnesium, 0.3 to 1 percent manganese, a maximum of 0.25 percent chromium, about 0.1 percent copper, up to about 0.3 percent iron, up to about 0.2 percent silicon, and the balance substantially all aluminum. Generally, the alloy is cast into a slab of a suitable thickness and subjected to a homogenizing heat treatment. The slab is then gradually reduced in thickness by a series of hot rolling operations to a strip in the range of twenty to forty millimeters depending somewhat on the goal for the final thickness of the sheet. The strip is then cold rolled, usually in stages with possible interposed anneals, to a final sheet thickness in the range of about one to three or four millimeters. The result of the thermomechanical processing is a coil of smooth surface aluminum sheet stock, the microstructure of which has been severely strained.

The cold rolled strip is not suitable for a high elongation forming operation. It must be reheated to recrystallize the elongated, strained grains that characterize its microstructure by the nucleation and growth of nearly strain-free grains. The goal of the recrystallizing heat treatment in the case of AA5083 sheet is to produce a very fine grained microstructure characterized by a principal phase of a solid solution of magnesium in aluminum, with well distributed, finely disbursed particles of intermetallic compounds containing minor alloying constituents such as, $Al_6Mn$. The recrystallized grain size in the microstructure is uniformly about ten to fifteen micrometers. Because the dispersed phase is so small the material is sometimes described as "pseudo single phase." The fine-grained sheet can be heated and superplastically formed into a complex part like an automotive body panel. The sheet can sustain substantial elongation at a suitable strain rate and at a temperature in the range of about 440° C. (825° F.) to about 550° C. (1020° F.).

U.S. Pat. No. 6,253,588 entitled "Quick Plastic Forming of Aluminum Alloy Sheet Metal," by Rashid et al. and assigned to the assignee of this invention, discloses practices by which the aluminum alloy sheet metal is stretch formed at a suitable forming temperature into automotive body panels and the like. The '588 patent describes practices for forming aluminum alloy sheet metal using a pressurized working fluid such as air. In accordance with this practice, the sheet metal blank is first placed on a pre-bending and heating tool. The heated tool heats the sheet metal blank to its forming temperature and pre-bends it, if desired, for placement on a second tool configured for stretch-forming the heated sheet into a body panel or the like. The heated blank is then clamped at its edges and gas pressure is applied which forces the sheet into the tool cavity to assume the requisite shape of the part. The preparation of the sheet material before forming is critical so that it can sustain the deformation necessary to form the part and retain a commercially acceptable surface finish.

If the sheet metal blank selected for forming has been recrystallized by the coil manufacturer (i.e., supplied in the soft, fully annealed O temper condition), the heating on the pre-heat tool may further the grain growth of its microstructure. Alternatively, if a blank is taken from a cold rolled coil supplied without heat treatment, e.g., in the H18 temper, the metal is not formable because it has experienced a cold rolling reduction of 74% or more as a last processing step. When an un-recrystallized blank is placed on the preheat and pre-bend tool of the Rashid, et al, '588 patent disclosure, the sheet material is recrystallized as it is slowly heated to the panel forming temperature over a period of five to ten minutes. Once the sheet has been recrystallized and reaches a forming temperature, for example, in the range of 825° F. to 845° F. (about 441° C. to 452° C.), it is bent and transferred to a heated forming press in which it is stretch formed into a vehicle body panel or the like.

The prolonged preheating of the sheet metal blank to effect recrystallization of the cold-worked sheet to produce a superplastic formable microstructure has taken five to ten minutes but produced a very formable sheet. Slow recrystallization of the sheet metal on a forming tool has been used in the commercial production of body panels. However, the heating times on the open tools have not been consistent and the heating time has become rate limiting for the overall forming process described in the '588 patent. It is now desired to start with blanks from a cold worked coil and more rapidly heat them to enable a faster rate of production. Hopefully, the more rapid heating rate will also produce an even finer recrystallized grain size and greater superplastic ductility.

Accordingly, it is an object of this invention to provide a method of consistently heating a cold-worked, superplastically formable, aluminum alloy sheet so as to quickly convert its highly strained microstructure into a recrystallized fine grained microstructure that is suitable for a superplastic forming operation. At the same time that the sheet is being recrystallized it is being heated to a suitable forming temperature, such as a stretch forming temperature. It is also an object of the invention to provide such a heating method applicable to other cold worked sheet metal alloys that can be recrystallized under static conditions to a highly deformable pseudo single phase material.

SUMMARY OF THE INVENTION

It has been found that it is possible and practical to rapidly recrystallize a sheet blank of cold worked, H18 temper, AA 5083 material, sized for vehicle body panel manufacture, and heat it to a suitable superplastic forming temperature. In accordance with a preferred embodiment of the invention, a sheet is placed in an oven adapted for recirculating, forced flow, hot air convection heating of the sheet. However, the principal initial rapid heating of the sheet is accomplished by also using infrared heating rods suitably closely spaced to a surface of the sheet.

The infrared radiant heating rods are turned on with the cold sheet in place, for example, on a ceramic hearth of the oven. The efficient radiation heating rapidly raises the temperature of the thin metal and induces recrystallization of the cold worked strained grains of its microstructure. At the same time the forced flow of hot air is directed against and across the surface of the sheet, also heating it. The radiant heaters are turned off at a suitable, predetermined time during the heating cycle to avoid excessive heating or localized melting of the sheet. The temperature of the circulating air is controlled to limit the maximum temperature of the sheet. The circulating air flowing against the sheet serves to produce a more uniform temperature distribution in the sheet. For example, the air temperature may be controlled at about 900° F. to limit the radiantly heated sheet to about the same temperature. The circulating air also serves to "cool" and limit the temperature of the much hotter (1500 to 1700° F.) radiant heater elements.

It is found that the sheet is suitably recrystallized to a microstructure for superplastic forming and heated to a suitable temperature for such forming within a period of, for example, sixty to one hundred fifty seconds. Advantageously, this period is comparable to the actual panel forming operation so that the heating operation no longer slows the panel manufacturing process. The hot sheet is removed from the oven and, without intentional cooling, placed on a forming tool for pre-bending and/or final part formation.

This invention is likewise applicable to the static recrystallization of other pseudo single phase alloys such as aluminum alloys of the AA 2xxx series, other alloys of the AA5xxx series, alloys of the AA7xxx series, as well as suitable magnesium, ferrous and titanium superplastic alloys.

Other objects and advantages of the invention will became apparent from a detailed description of a preferred embodiment which follows.

DESCRIPTION OF THE PREFERRED EMBODIMENT

Superplastic metals can undergo large uniform strains prior to failure. The ability of a metal to deform superplatically depends primarily on its composition, grain size, strain rate, and deformation temperature. Metals that behave superplastically usually have a grain size less than about 10 micrometers and they are deformed within the strain rate range of $10^{-5}$ to $10^{-1}$ per second at temperatures greater than about half of their absolute melting temperature (0.5 T). The fine grain size is believed to allow grain boundary sliding and grain rotation to contribute to the large superplastic strains. Therefore, in order to deform superplastically, an aluminum alloy or other superplastic alloy of, for example, titanium, copper or magnesium must first be capable of being processed into a fine grain structure that is resistant to grain growth during deformation.

This invention is applicable to superplastic sheet metal alloys that are statically recrystallized to a fine grain structure prior to a forming operation. The practice of the invention will be illustrated in connection with magnesium-containing aluminum sheet alloys, specifically AA 5083. Production of the alloy sheet includes a combination of hot rolling, cold rolling and a final heat treatment to develop small recrystallized grains of aluminum-magnesium solid solution with dispersed insoluble particles.

AA5083, aluminum sheet alloy is suitably received from a supplier in the heavily cold-worked (e.g., H18 temper designation) condition. As stated above regarding the Rashid et al '588 patent, in actual manufacturing operations the sheet material has been recrystallized at a relatively slow heating rate as it is preheated, usually on an open hot pre-bending tool. The heating process often takes 10 minutes or more to suitably recrystallize the sheet material. It has now been discovered that the recrystallizing can be accomplished at a much faster rate provided suitable heating techniques are provided.

Figure 1:
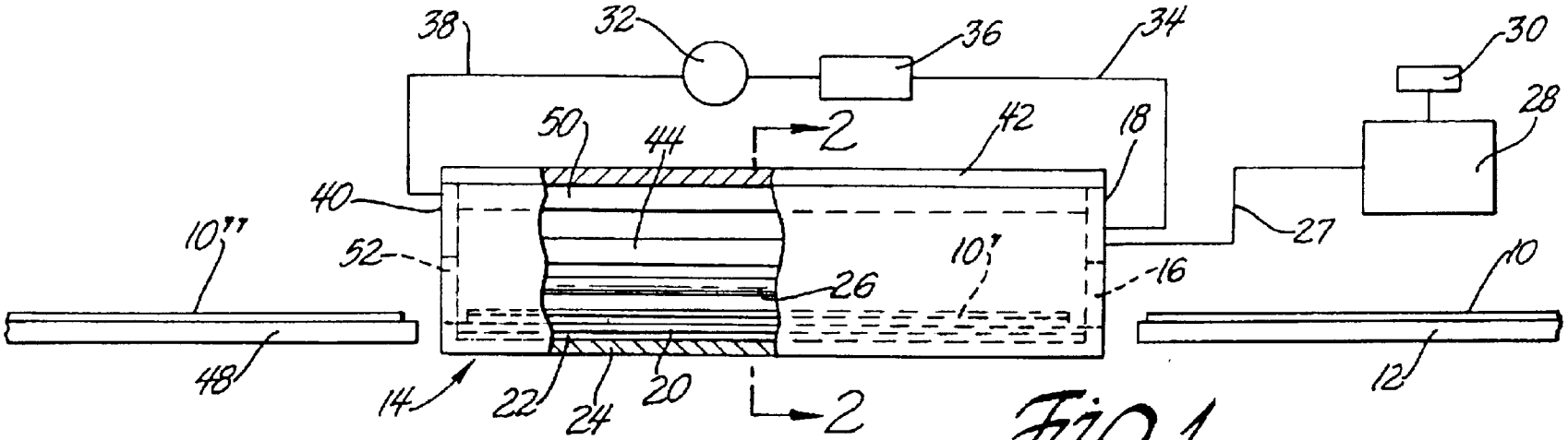
FIG. 1 is a schematic flow diagram of a convection and radiant heating oven and related conveying and control equipment for use in heating cold worked sheet metal blanks in accordance with this invention.
Figure 2:
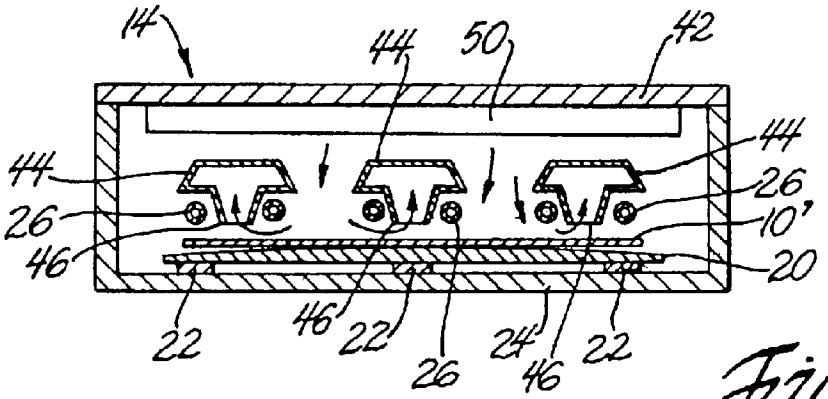
FIG. 2 is a cross sectional view of the oven taken at plane 2—2 of FIG. 1.

In accordance with the invention, a combination of convection heating and infrared radiation heating is employed to rapidly heat a suitably cold worked sheet metal blank. The heat is controlled to recrystallize the microstructure of the blank for uniform deformation and to heat it to a forming temperature suitable for the manufacturing process. The heat treated sheet material is then subjected to its intended forming operation before cooling to ambient temperature. Reference is made to FIGS. 1 and 2 to illustrate a preferred embodiment of the process.

An incoming cold-worked sheet metal blank 10 is positioned on a support table 12 or conveyor just upstream of heat treating oven 14. A blank for an automotive vehicle body panel may, for example, have dimensions of 1625 mm (64 inches)×1117 mm (44 inches)×1.6 mm. It is often coated on one or both sides with a film of boron nitride lubricant particles. Oven 14 is sized to accommodate at least one such panel and enclose heating means described below. When the oven 14 is available, the blank 10 is pushed or otherwise suitably transported through slideable door 16 in the entrance end 18 of oven 14 onto a hearth 20 in the lower portion of oven 14. When the blank is positioned in oven 14, it is identified as 10'. Hearth 20 is suitably formed of a ceramic or refractory material can be supported for example on beams 22 on the floor 24 of oven 14 as illustrated schematically in FIG. 2. Hearth 20 may have a slightly convex upper surface so that edges of the flat sheet 10' do not lie on the hearth and can be used for suitable movement of the blank in and out of oven 14. For example, the edges of the blanks may be guided in rails (not shown) or gripped by robots with suitable end effectors (not shown) for transporting the blank 10'.

In this embodiment of the invention, the thin sheet 10', typically 1 to 4 mm thick, is heated by convection and radiation principally through its exposed upper surface as seen in FIGS. 1 and 2. However, the hearth 20 is heated in the oven and provides a hot backing for sheet 10'. It will be appreciated that other arrangements for supporting sheet 10 could be devised such as for heating from both sides. However, for simplicity of oven construction, the FIGS. 1 and 2 embodiment is preferred.

Blank 10 is heated in oven 14 by a combination of recirculating hot air convection heating and infrared radiant heating. As best seen in FIG. 2 a plurality (six shown) of infrared heating rods 26 extend substantially the length of oven 14. They are aligned parallel to each other along the length of sheet 10 as it is supported on hearth 20 in oven 14. They are also positioned parallel to the upper surface of blank 10' and separated from it by a distance of about two and a half to three inches. Rods 26 are suitably commercially available, high wattage electrical resistance heaters for emission of infrared energy. Heating rods 26 are connected through lead 27 to electrical power source 28. Power source 28 is operated by controller 30 in performance of the heating process of this invention. A preferred operating temperature of the rods during their heating mode for the AA5083 blanks is about 1500 to 1700° F.

In addition to the infrared radiant heating elements 26, convection heating is used. Convection heating is used both to supplement the rapid heating by the infrared heaters and to control the highest temperature of the sheet 10'.

Heated air is circulated through oven 14 using blower 32 (see FIG. 1). Blower 32 draws air from the return plenum of oven 14 through insulated hot air duct 34. The hot air thus exhausted from oven 14 is drawn over electrical resistance heaters (powered, e.g., by a 480 V, 3-phase, 60 Hz source) located in air heater 36. Blower 32 propels the heated air through duct section 38 back into oven 14. A suitable hot air circulation rate for a body panel as described may be about 8000 cubic feet per hour.

The heated air is introduced into oven 14 at its supply plenum 50 near the top 42. The hot air flow is directed downwardly against the sheet metal stock 10' resting on the hearth 20. By way of example, a plenum 50 along the top of oven 14 carries the incoming heated air along the full length of the oven and directs flow downwardly through outlets spaced regularly along the length. Thus hot air is directed generally perpendicularly against sheet 10'.

A plurality of parallel, air return plenums 44 are positioned parallel to the length of the oven. Three are seen in cross-section in FIG. 2. Each hot air return plenum 44 has a tapered inlet portion 46 extending between two infrared heating rods 26. Hot air rebounds from the surface of sheet 10' and is drawn by blower suction into inlets 46. The return air flows in each plenum 44 to the end of the oven where the separate return streams are gathered in a manifold, not shown, and channeled into return duct 34.

When a new sheet 10 is moved through door 16 into oven 14 on hearth 20 the hot air flow is started and power is supplied to the infrared heaters. An exemplary goal for this heating process may be to heat the cold worked sheet to a temperature of, 900° F. in less than 150 seconds. This heating program is to transform the microstructure from severely strained, cold worked grains to a recrystallized fine grain, pseudo single phase, soft (e.g., O Temper). And the sheet is to be heated to a temperature at which it can be stretched and/or drawn into a body panel or the like product of complex shape.

If the desired final temperature of the sheet is 900° F. the hot air temperature impinging the sheet will be suitably controlled to 900 to 910° F. The infrared heaters, powered by supply 28 under controller 30 will be at, for example 1500° F. The high temperature radiant heaters rapidly heat sheet 10' toward its specified temperature. The sheet is typically coated with a thin film of boron nitride particles which serves as a lubricant between the surface of the sheet and the surface of the tool over which the sheet will be stretched or drawn. The white BN film raises the emissivity of the somewhat reflective aluminum sheet and the overall emissivity of the coated sheet may be about 0.2. As the temperature of the sheet is approaching 900° F. the radiant heaters are tuned off to prevent overheating or even localized melting of the sheet. The timing is critical to maximize heating rate without excessive heating. Unless a reliable heating model for the oven, heating system, and work pieces is available, the time for radiant heater shut off will be determined experimentally on test panels. For example, it may be determined to shut off the radiant heaters 26 after they have been operating for 100 seconds. Thereafter, the flow of heated air continues to heat and/or cool portions of the sheet to bring sheet 10' to a uniform temperature of 900° F. as quickly as practical. The flowing air also cools the radiant heaters 26 to help lengthen their useful life.

The heated sheet 10' is removed from oven 14 by pulling, sliding or lifting it through exit door 52 onto surface 48. The hot sheet can then be placed on a forming tool to utilize its softened and formable condition. Since the removed heated sheet 10" is at its forming temperature it is transferred without undue delay to the forming tool. If some delay and cooling is anticipated it may be desired to heat the sheet 10' to a slightly higher temperature to tolerate such cooling before forming.

Thus, a controlled combination of radiant heating and convection heating is used to rapidly transform (recrystallize) a cold worked sheet of suitable metal alloy to a highly formable microstructure and heat it to a suitable forming temperature to utilize the newly acquired formability. In the case of a cold worked AA5083 sheet the heating period is less than 150 seconds, often 60 to 90 seconds. The formability of the AA 5083 sheet typically exceeds $300^{+}$ % elongation by standard tensile test.

While the practice of the invention has been illustrated in terms of its application to certain aluminum alloys, it is recognized that it is also applicable to other aluminum alloys and other cold worked sheet metal alloys, especially those that be recrystallized to a superplastic forming condition. Accordingly, the scope of the invention is not limited by the exemplary description.

What is claimed is:

1. A method of forming a sheet of a superplastic formable, metal alloy composition comprising providing a cold worked sheet of said metal alloy composition, heating said cold worked sheet by infrared radiation and hot air convection to recrystallize the cold worked microstructure of said sheet to a fine grained microstructure suitable for superplastic forming, and to heat said sheet to a superplastic forming temperature and forming the heated sheet.

2. A method as recited in claim 1 comprising heating said cold worked sheet by combined infrared radiation and hot air convection to a predetermined sheet temperature to recrystallize the cold worked microstructure of said sheet to a fine grained microstructure suitable for superplastic forming, and to heat said sheet to a superplastic forming temperature; said heating comprising discontinuing said infrared radiation heating before said sheet reaches said predetermined temperature, and continuing to heat said sheet to said predetermined temperature with said convection heating.

3. A method as recited in claim 2 in which said heating by infrared radiation comprises heating with electrical resistance heaters, and discontinuing said infrared radiation heating comprises shutting off the electrical power to said heaters.

4. A method of forming a sheet of a superplastic formable, aluminum alloy composition comprising providing a cold worked sheet of said composition, heating said cold worked sheet by infrared radiation and hot air convection to recrystallize the cold worked microstructure of said sheet to a fine grained microstructure suitable for superplastic stretch forming, and to heat said sheet to a superplastic forming temperature, within a period of 150 seconds, and forming the heated sheet.

5. A method as recited in claim 4 in which said sheet is of a superplasticly formable magnesium containing aluminum alloy composition.

6. A method as recited in claim 4 comprising providing a cold worked sheet that has experienced a cold work reduction to a H18 temper state.

7. A method of forming a sheet of a superplastic formable, aluminum alloy composition comprising providing a cold worked sheet of said composition, heating said cold worked sheet by combined infrared radiation and hot air convection to a predetermined sheet temperature to recrystallize the cold worked microstructure of said sheet to a fine grained microstructure suitable for superplastic stretch forming, and to heat said sheet to a superplastic forming temperature; said heating comprising discontinuing said infrared radiation heating before said sheet reaches said predetermined temperature, and continuing to heat said sheet to said predetermined temperature with said convection heating, and then forming the heated sheet.

8. A method as recited in claim 7 in which said sheet is a magnesium containing, aluminum alloy sheet.

9. A method as recited in claim 7 in which said infrared radiation is produced with electrical resistance heating elements maintained at a temperature in the range of 1500 to 1700° F.

10. A method as recited in claim 7 in which said hot air convection heating is accomplished by controlling the temperature of said air to a predetermined air temperature above said predetermined sheet temperature.

11. A method as recited in claim 10 in which said heating by infrared radiation comprises heating with electrical resistance heaters, and discontinuing said infrared radiation heating comprises shutting off the electrical power to said heaters.

12. A method as recited in claim 7 in which said hot air convection heating is accomplished by controlling the temperature of said air to a predetermined air temperature within a range of ten Fahrenheit degrees above said predetermined sheet temperature.

* * * * *